US005155873A

United States Patent [19]

Bridges

[11] Patent Number: 5,155,873

[45] Date of Patent: Oct. 20, 1992

[54] ELECTRICALLY OPERATED LIFT STOOL

[76] Inventor: Bobby L. Bridges, Rte. 2, Box 3492, Nicholson, Ga. 30565

[21] Appl. No.: 568,702

[22] Filed: Aug. 17, 1990

[51] Int. Cl.[5] ..... A47K 13/10

[52] U.S. Cl. ..... 4/667; 297/330; 297/417; 297/DIG. 10

[58] Field of Search ..... 4/251, 254, 237, 560, 4/564, 518; 297/330, 417; 5/81 R

[56] References Cited

U.S. PATENT DOCUMENTS

| | | | |
|---|---|---|---|
| 429,952 | 6/1890 | Pratt | 4/251 |
| 3,473,174 | 10/1969 | Cool | 4/237 X |
| 3,474,471 | 10/1969 | Matiby | 297/417 |
| 3,596,298 | 8/1971 | Durst | 297/DIG. 10 X |
| 3,925,833 | 12/1975 | Hunter | 4/251 |
| 4,168,552 | 9/1979 | Austin | 4/237 |
| 4,185,335 | 1/1980 | Alvis | 4/251 |
| 4,581,778 | 4/1986 | Pontoppidan | 4/251 |
| 4,587,678 | 2/1987 | Love et al. | 4/251 |
| 4,850,645 | 7/1989 | Crockett | 297/DIG. 10 X |
| 4,884,841 | 12/1989 | Holley | 297/DIG. 10 X |
| 4,888,833 | 12/1989 | Garcia et al. | 4/251 X |
| 4,894,871 | 1/1990 | Schmerler | 4/254 |
| 4,907,303 | 3/1990 | Baird | 297/DIG. 10 X |
| 4,956,123 | 8/1990 | Henderson et al. | 5/81 R X |
| 4,993,085 | 2/1991 | Gibbons | 4/251 |

*Primary Examiner*—Henry J. Recla
*Assistant Examiner*—Glenn T. Barrett
*Attorney, Agent, or Firm*—Fleit, Jacobson, Cohn, Price, Holman & Stern

[57] ABSTRACT

A lift stool for use in conjunction with removable pot or a stationary toilet bowl is provided to assist disabled person in being lowered toward a seated position and elevated back up to a standing position and the lift stool includes elevated arms rests which may be swung upwardly to out of the way positions to enable a person to assist a more seriously disabled person in using the lift stool, a control for raising and lowering the associated toilet seat being mounted from one of the free swinging ends of the upwardly swingable arms rests and the lift stool including support wheels normally spaced slightly above a horizontal surface upon which the lift stool rests and over and onto which the lift stool may be rearwardly tilted to a position in which the raised armrests may be used as handlebars for manually rolling the lift stool over a floor surface.

9 Claims, 2 Drawing Sheets

ELECTRICALLY OPERATED LIFT STOOL

BACKGROUND OF THE INVENTION

1. Field of the Invention

This invention relates to a lift stool for supporting a toilet seat in operative association with a toilet bowl and which may used to lower and raise a disabled person relative to the associated toilet bowl. In addition, the lift stool, in addition to supporting a toilet seat therefrom, also includes structure by which a portable pot may be removably supported immediately beneath the toilet seat for use as a receptacle for human waste in the absence of an associated toilet bowl.

2. Description of Related Art

Various different forms of lift stools for use in conjunction with toilet bowls and the like heretofore have been provided such as those disclosed in U.S. Pat. Nos. 3,925,833, 4,168,552, 4,185,335, 4,581,778, 4,587,678. However, these previously known forms of lift stools do not include various refinement and safety features incorporated in the lift stool of the instant invention.

SUMMARY OF THE INVENTION

The lift stool of the instant invention includes a base which is generally U-shaped in plan and opens in a rearward direction for positioning in embracing relation about the base of a toilet bowl and a seat support is mounted in elevated position relative to the base and provided with a toilet seat for positioning over the associated toilet bowl.

Support means is interconnected between the base and the seat support for raising and lower the latter relative to the associated toilet bowl and the support means is operative to forwardly tilt the seat support as it is raised relative to the associated toilet bowl. Still further, opposite side portions of the seat support include upwardly projecting armrest mounts from which front-to-rear extending armrests are supported for pivotal movement between forwardly projecting horizontal positions and upwardly projecting generally vertical positions. Reversible motor means is operatively associated with the support means for reversibly actuating the latter to raise and lower the seat support and the forward portion of one of the armrests includes manually operable control means for the electric motor means.

An additional feature of the invention enables the seat support to be adjusted vertically relative to the support means by which the seat support is raised and lowered relative to the base and in this manner the seat support may be adjusted according to the height of the associated toilet bowl independent of the motor means operatively associated with the support means. Another feature of the instant invention is that the reversible electric motor means includes a control for limiting operation of the electric motor means in both directions, independent of the reversing control means carried by one of the armrests. Finally, the armrests, when in their upwardly projecting positions, define handlebars and the rear portion of the base includes support wheels elevated above the undersurfaces of the base when the latter is horizontally disposed and disposed lowermost when the lift stool is rotated rearwardly approximately 45 degrees over the support wheels to enable the armrest then to be used as handlebars in rollingly transporting the lift stool from one location to another.

The main object of this invention is to provide a lift stool for operative association with a toilet bowl and which may used to facilitate downward movement of a disabled person in a seated position over a toilet bowl and the raising of the disabled person into a standing position from a seated position over the associated toilet bowl.

Another object of this invention is to provide a lift stool in accordance with the preceding objects and including armrests for the user and which may be pivoted upwardly into out of the way positions in the event the disabled person requires one or two assistants in order to assume, in conjunction with the lift stool, a seated position over an associated toilet bowl.

Another important object of this invention is to provide a lift stool for supporting a toilet seat in position closely spaced over a toilet bowl and including structure by which the elevation of the toilet seat may be adjusted according to the height of the toilet bowl and independent of the lift mechanism for that portion of the lift stool that supports the toilet seat therefrom.

Still another important object of this invention is to provide a lift stool in accordance with the preceding objects and which also includes structure for removably supporting a waste pot immediately beneath the toilet seat thereof, to thereby enable the lift stool to be used in a disabled persons room independent of a toilet bowl.

A further important object of this invention is to provide a lift stool wherein the electric motor means provided for lifting the toilet seat relative to the base of the lift stool includes a control therefore mounted from the forward end of one of the upwardly swingable armrests of the lift stool, thereby enabling an assistant to control the reversible electric motor means while also manually assisting the associated patient with one arm.

A further object of this invention, in accordance with the immediately preceding object, is to provide reversible electric motor means including limit controls for limiting operation of the electric motor means in opposite directions independent of the armrest supported control.

A final object of this to be specifically enumerated herein is to provide an electrically operated lift stool in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
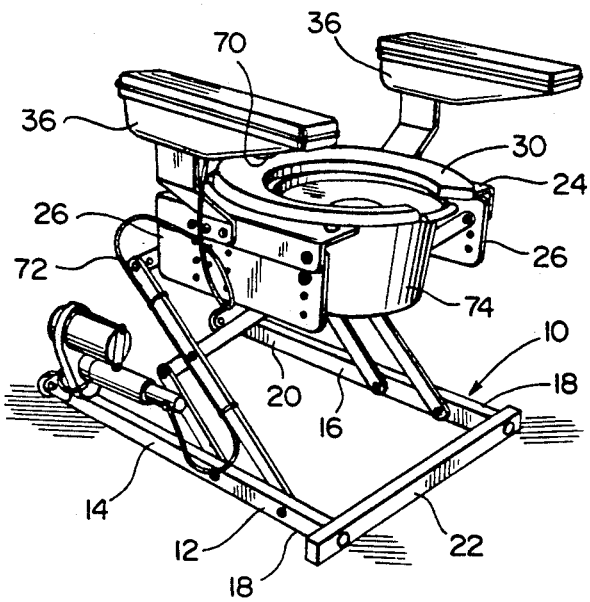
FIG. 1 is a left side perspective view of the lift stool of the instant invention with the seat support thereof in a fully lowered position, the armrest portions thereof in their lowered horizontal and forwardly projecting positions and with a pot removably supported from the seat support thereof.

Referring now more specifically to the drawings the numeral 10 generally designates the lift stool of the instant invention. The lift stool 10 includes a base 12 which generally U-shaped in plan and includes a pair of generally parallel sides 14 and 16 having front and rear ends 18 and 20 as well as a forward transverse member 22 extending between and interconnecting the front ends 18 of the sides 14 and 16.

Figure 5:
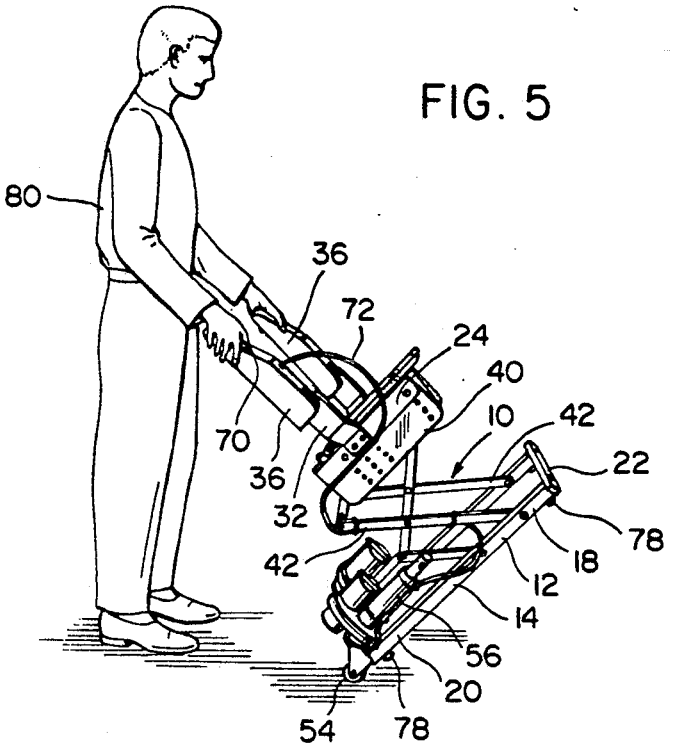
FIG. 5 is a left side perspective view of the lift stool illustrating the manner in which the latter may be transported from one location to another in a manner similar to the manner in which a wheelbarrow is transported from one location to another.

A seat support 24 is disposed above the base 12 and includes a pair of front-to-rear extending opposite side members 26 interconnected at their rear ends by a rear transverse member 28. A toilet seat 30 of conventional design is supported from the rear transverse member 28 and rear portions of the opposite side members 24 include upwardly projecting supports 32 having upper portions 34 from which front-to-rear extending armrests 36 are oscillatably supported as at 38 (see FIG. 2) for angularly displacement between the horizontally disposed forwardly projecting positions illustrated in FIG. 1 and upwardly projecting positions illustrated in FIG. 5.

The side members 26 include depending opposite side adjustment plate portions 40 supported therefrom and opposite side lazy tong linkages 42 are interconnected between each side 14 and 16 and the corresponding adjustment plate portions 40. The adjustment plate portions 40 are removably supported from the side members 26 through the utilization of fasteners 44 and the upstanding supports 32 are removably supported from the side members 44 and plate portions 40 through the utilization of fasteners 46. In addition, the upper ends of the lazy tong linkages 42 are pivotally supported from the plate portions 40 by fasteners 46 secured through selected vertical spaced sets of horizontally registered apertures 48 formed through the plate portions 40. Accordingly, the seat support 24 may be vertically adjusted relative to the lazy tong linkages 42.

The supports 32 include upper end front and rear apertures through the fasteners 38 are received and, accordingly, the supports 32 are identically formed. In addition, the plate portions 40 are identically formed and the opposite side members 24 are identically formed as are the armrests 36 except for one of the armrests being provided with an operating switch as will be hereinafter more fully set forth.

Mounted from the rear ends 20 of the sides 14 and 16 of the base 12 are pairs of parallel bracket plates 52. Small diameter support wheels are journaled from lower rear portions of the plates 52 and corresponding ends of a pair of reversible electric motor driven screw jack assemblies 56 are pivotally supported as at 58 between upper ends of the pairs of plates 52, the other ends of the screw jack assemblies 56 being pivotally anchored as at 60 to control links 62 of the lazy tong linkages 42.

Figure 2:
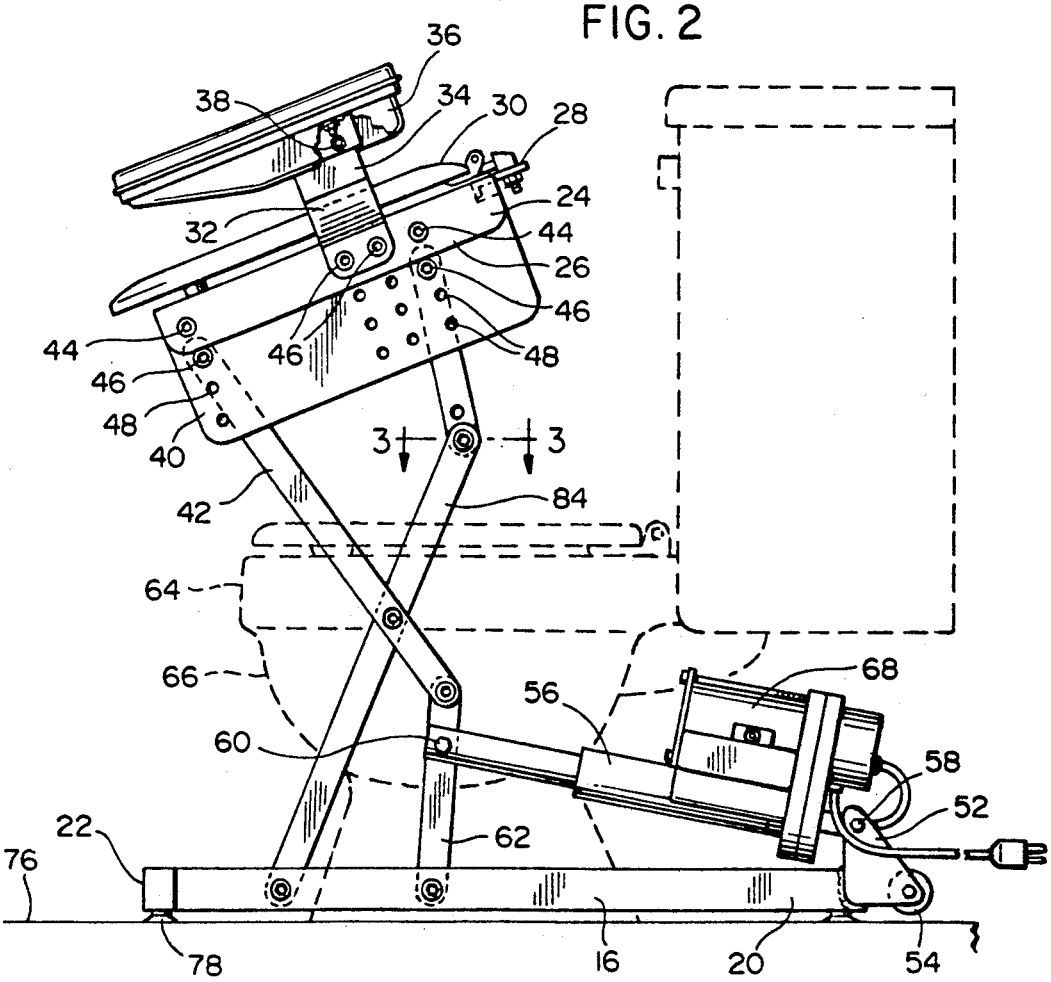
FIG. 2 is an enlarged right side elevational view of the lift stool with the seat support in an elevated position and a portion of the near side armrest being broken away to illustrate the pivotal mounting thereof.

From a comparison of FIGS. 1 and 2 it may be seen that the screw jack assemblies 56 may be used to raise and forwardly tilt the seat support 24 from the lowered horizontal position thereof illustrated in FIG. 1 to the raised and forwardly tilted position thereof illustrated in FIG. 2. It is to be noted that the plate portions 40 are in their lowest positions relative to the lazy tong linkages 42 for close positioning of the seat support 24 over the upper portion 64 of a conventional low toilet bowl 66. Accordingly, if the upper portion 64 of the toilet bowl 66 is higher, the plate portions 40 may be raised relative to the upper portions of the lazy tong linkages 42.

Figure 4:
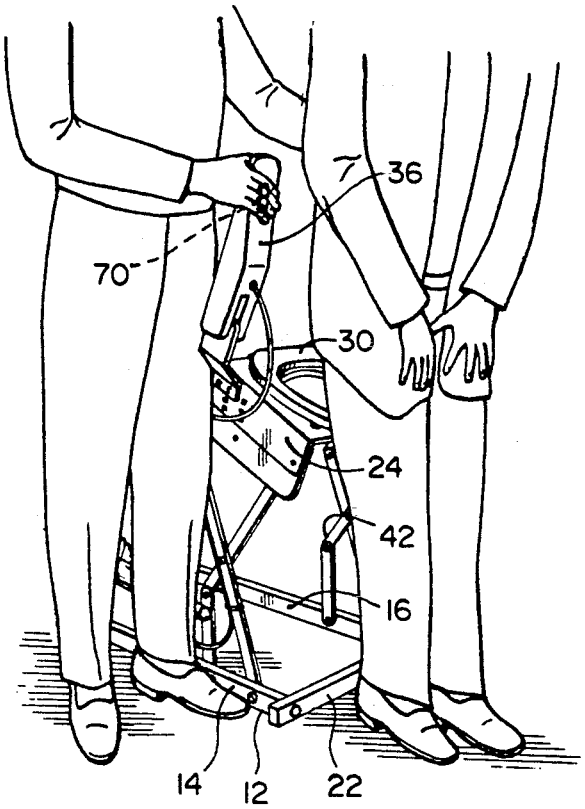
FIG. 4 is a left side perspective view of the lift stool with the seat support thereof in an elevated position, the left side armrest thereof in an elevated position and an assistant having one hand positioned on the armrest for actuation of the motor control and the other hand positioned to assist a person to assume a seated position relative to the raised seat support.

The reversible electric motor driven screw jack assemblies may be of any suitable type, but model MC 42-1002 (equipped with one horsepower motors) available through HUBBELL Special Products, Inc. of Kenosha, Wisconsin have been found to be beneficial in that they may be electrically connected for simultaneous and equal operation and provided with automatic stops for terminating operation of the electric motors 68 thereof to define both the extended and retracted positions of the lazy tong linkages 42. In addition, the screw jack assemblies 56 have a reversible electric control 70 therefore mounted from the forward end portion of the left side armrest 36 and operatively associated with the left side screw jack assembly motor 68 through suitable wiring 72, see FIGS. 1, 4 and 5. The control 70 controls the operation of the left side screw jack assembly 56 and the right side screw jack assembly 56 is controlled through the left side screw jack assembly 56, the built-in limits for limiting reverse operation of the left side screw jack assembly 56 also serving to limit reverse operation of the right side screw jack assembly 56.

The seat support 24 is equipped with front-to-rear extending guides (not shown) from which a removable pot 74 may be supported when the lift stool 10 is not operatively associated with a toilet bowl 66. However, when the lift stool 10 is to be associated with the toilet bowl 66, the pot 74 is removed. Accordingly, the lift stool 10 may not only be used in a bathroom, but also may be used in a patient's room in conjunction with the pot 74.

From a comparison of FIGS. 1 and 2 it may be noted that a person seated upon the toilet seat 30 illustrated in FIG. 1 may be upwardly and forwardly displace toward a full standing position by movement of the seat support 24 from the position thereof illustrated in FIG. 1 to the position thereof illustrated in FIG. 2. Furthermore, the base 12 may be operatively embracingly engaged about the toilet bowl 66 in the manner illustrated in FIG. 2 and stationarily supported from the floor 76 about the toilet bowl 66 through the utilization of non-slip feet 78 supported from the front and rear ends of the sides 14 and 16 of the base 12. In addition, with attention invited more specifically to FIG. 2, when the base 12 is in the horizontal position, the lower peripheral portions of the support wheels 54 are disposed above the floor 76. However, when the armrests 36 are swung to the upwardly extending positions thereof illustrated in FIG. 5, an operator or person 80 may grasp the armrests 36 and use the same as handlebars in order to rearwardly tilt the lift stool 10 approximately 45 degrees from the horizontal position thereof illustrated in FIG. 1 to the tilted thereof illustrated in FIG. 5 and the person or operator 80 may then rollingly transport the lift stool 1 any desired location. Also by lifting transverse member 22 onto the support wheels 54 the lift stool may be rolled into position over the toilet bowl.

Figure 3:
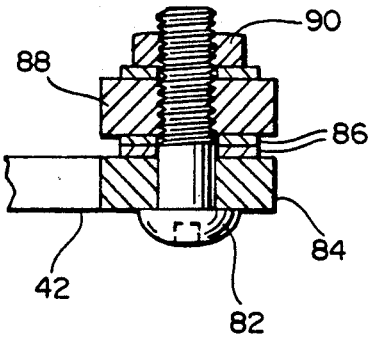
FIG. 3 is an enlarged fragmentary horizontal sectional view taken substantially upon the plane indicated by the section line 3—3 of FIG. 2.

With attention now invited more specifically to FIG. 3 of the drawings, the pivot connections of the lazy tong linkages 42 are defined by pivot bolts 82. Each pivot bolt 82 is rotatably received through one member 84 of the associated linkage 42, rotatably received through a pair of washers 86 disposed between the one member 84 and a second member 88 of the linkage 42, threadedly engaged through the second member 88 and then has a jam nut 90 threadedly engaged therewith on the side of the second member 88 remote from the first member 84. By this type of pivot connection, substantially all movement between relatively pivotally connected members other than pivotal movement is eliminated.

The foregoing is considered as illustrative only of the principles of the invention. Further, since numerous, modifications and changes will readily occur to those skilled in the art, it is not desired to limit the invention to the exact construction and operation shown and described, and accordingly, all suitable modifications and equivalents may be resorted to, falling within the scope of the invention.

What is claimed is as follows:

1. An electrically operated lift stool including a base incorporating generally parallel sides having front and rear ends and a forward transverse member extending between and interconnecting the front ends of said sides, a generally horizontal seat support for supporting a toilet seat therefrom and including opposite side members, support means interconnected between said opposite side members and said sides supporting said seat support from said base for vertical shifting relative thereto, said support means including reversible electric motor means for actuating said support means to raise and lower said seat support, said opposite side members each including elevated rear portions and an elongated front-to-rear extending armrest having front and rear end portions supported therefrom, said rear end portions being pivotally supported from said elevated rear portions for oscillation of said armrests relative to said elevated rear portions, each about a horizontal transverse pivot axis, between lowered forwardly projecting horizontal positions elevated appreciably above said seat support and raised upwardly projecting positions, said reversible electric motor means including operation reverse and control means operatively associated with said electric motor means for selectively and reversibly actuating said electric motor means, said control means being carried by one of said armrests forward of the pivot axis thereof relative to the corresponding elevated rear position.

2. The lift stool of claim 1 wherein said base includes supporting undersurface portions for engaging and non-slip support from a horizontal support surface over which said base is disposed.

3. The lift support of claim 2 wherein the rear ends of said sides includes support wheels journaled therefrom for rotation about horizontal transverse axes, said support wheels including lower peripheral portions thereof elevated at least slightly relative to said undersurface portions when the latter are engaged with and supported from a horizontal support surface, said armrests, when in said raised positions, defining handlebars by which said lift stool may be tilted generally 45 degrees rearwardly over said support wheels for transport of said lift stool from the rear in the manner in which a wheelbarrow is manually maneuvered, said base, when said lift stool is tilted rearwardly, being disposed entirely above said lower peripheral portions.

4. The lift stool of claim 3 wherein said reversible electric motor means includes limit means operatively associated with said operation reversing control means for automatically terminating operation of said electric motor means in each of the reversing modes of operation thereof independent of operation of said operation reverse and control means.

5. An electrically operated lift stool including a base incorporating generally parallel sides having front and rear ends and a forward transverse member extending between and interconnecting the front ends of said sides, a generally horizontal seat support for supporting a toilet seat therefrom and including opposite side members, support means interconnected between said opposite side members and said sides supporting said seat support from said base for vertical shifting relative thereto, said support means including reversible electric motor means for actuating said support means to raise and lower said seat support, said opposite side members each including elevated rear portions and an elongated front-to-rear extending armrests having front and rear end portions supported therefrom, said rear end portions being pivotally supported from said elevated rear portions for oscillation of said armrests relative to said elevated rear portions between lowered forwardly projecting horizontal positions elevated appreciably above said seat support and raised upwardly projecting positions, said base including support undersurface portions for engaging and non-slip support from a horizontal surface over which said base is supported, the rear ends of said sides including support wheels supported therefrom for rotation about horizontal transverse axes, said support wheels including lower peripheral portions elevated at least slightly relative to said undersurface portions when the latter are engaged with and supported from a horizontal support surface, said armrests, when in said raised positions, defining handlebars by which said lift stool may be tilted rearwardly generally 45 degrees over said support wheels for transport of said lift stool from the rear in the manner in which a wheelbarrow is manually maneuvered, said base, when said lift stool is tilted rearwardly, being disposed entirely above said lower peripheral portions.

6. The lift steel of claim 5 wherein said support means and said seat support include adjustment means operative to support said seat support in height adjusted positions relative to said base independent of actuation of said support means by said reversible electric motor means.

7. The lift stool of claim 6 wherein said reversible electric motor means includes limit means operatively associated with said operation reversing control means for automatically terminating operation of said electric motor means in each of the reversing modes of operation thereof independent of operation of said reverse and control means.

8. An electrically operated lift stool including a base incorporating generally parallel sides having front and rear ends and a forward transverse member extending between and interconnecting the front ends of said sides, a generally horizontal seat support for supporting a toilet seat therefrom and including opposite side members, support means interconnected between said opposite side members and said sides supporting said seat support from said base for vertical shifting relative thereto, said support means including reversible electric motor means for actuating said support means to raise and lower said seat support, said opposite side members each including elevated rear portions and an elongated front-to-rear extending armrests having front and rear end portions supported therefrom, said rear end portions being pivotally supported from said elevated rear portions for oscillation of said armrests relative to said elevated rear portions, each about a horizontal transverse pivot axis, between lowered forwardly projecting horizontal positions elevated appreciably above said seat support and raised upwardly projecting positions, said reversible electric motor means including operation reverse and control means operatively associated with said electric motor means for selectively and reversibly actuating said electric motor means, said control means being carried by one of said armrests forward of the pivot axis thereof relative to the corresponding elevated rear portion said reversible electric motor means including stop means operatively associated with said operation reverse and control means for automatically terminating operation of said electric motor means in each of the reversing modes of operation thereof independent of operation of said reverse and control means, said support means and said seat support including adjustment means operative to support said seat support in height adjusted positions relative to said base independent of actuation of said support means by said reversible electric motor means.

9. The lift support of claim 8 wherein said support means is operative to forwardly tilt said seat support during raising of said seat support toward an upper position thereof from a lower position thereof.

* * * * *